United States Patent [19]

Rutter et al.

[11] Patent Number: 4,481,753

[45] Date of Patent: Nov. 13, 1984

[54] BAG FILLER-CAPPER

[75] Inventors: Christopher C. Rutter, Hayward; Gerald R. Hill, Alamo, both of Calif.

[73] Assignee: Champion International Corporation, Stamford, Conn.

[21] Appl. No.: 331,515

[22] Filed: Dec. 17, 1981

[51] Int. Cl.[3] ..... B65B 31/06

[52] U.S. Cl. ..... 53/471; 53/273; 53/281; 53/300; 53/310; 53/469; 141/10; 141/114

[58] Field of Search ..... 53/281, 268, 273, 471, 53/469, 310, 300, 249-251; 141/114, 166, 248, 10, 68, 350, 154, 313-317

[56] References Cited

U.S. PATENT DOCUMENTS

| | | | |
|---|---|---|---|
| 2,257,347 | 9/1941 | Raymer | 141/248 X |
| 2,972,214 | 2/1961 | Juin | 53/471 X |
| 3,479,795 | 11/1969 | Martin | 53/273 X |
| 3,483,666 | 12/1969 | Harmes et al. | 141/248 X |
| 3,516,220 | 6/1970 | Buford et al. | 53/300 X |
| 3,785,116 | 1/1974 | Munz et al. | 53/561 |
| 4,120,134 | 10/1978 | Scholle | 53/434 |
| 4,297,828 | 11/1981 | Krieger et al. | 53/282 |
| 4,363,203 | 12/1982 | Marshall et al. | 53/281 X |

*Primary Examiner*—James F. Coan

*Attorney, Agent, or Firm*—Evelyn M. Sommer

[57] ABSTRACT

A device for automatically filling and capping containers comprising a filler nozzle positioned above an elevator mechanism, a bag station spaced from and on one side of the filler nozzle and a cap station spaced from and on the opposite side of the filler nozzle, and a movable carriage having a cap chuck on one end and a bag chuck on the other and being mounted for controlled movement between the filler nozzle and the bag station and the filler nozzle and the cap station whereby when the carriage is moved to the bag station, a filled bag is capped at the cap chuck location and a new bag is simultaneously obtained by the bag chuck, when the carriage is moved to the cap station, the capped, filled bag is ejected, the newly obtained bag is received by the elevator mechanism and a new cap is substantially simultaneously obtained from the cap station and when the carriage is moved to an intermediate position, the elevator mechanism raises the new bag to be filled to the filler nozzle and lowers the filled bag to the capping position and the cycle repeats itself.

6 Claims, 5 Drawing Figures

BAG FILLER-CAPPER

BACKGROUND OF THE INVENTION

The present invention relates to a device for filling and capping containers or bags and in particular relates to a device for automatically filling and capping containers which are serially fed to the device.

Many uses are found today for flexible bags which must be filled with a product and then sealed. Many of these flexible bags have caps which are placed on spouts to seal the bags after they have been filled with the desired product. Conventional hand-fed fillers require the operator to load the bag in proximity of the nozzle into a bag spout holder that clamps the spout so that the filling nozzle can enter the spout and fill the bag with product. This method, of course, poses a safety problem for the operator. Also, other hand-fed filling machines stop and wait for the next bag to be loaded. If the operator's attention is diverted momentarily, this load time can increase substantially.

Automatic bag fillers also have been developed such as disclosed in U.S. Pat. No. 4,120,134 which utilizes a web of serrated bags feeding into the machine where the bags are filled with product, capped and separated from the web. While this method is much safer for the operator, it has several difficulties associated with it. One of the difficulties is that the filling nozzle must move to and from the bag spout in order to fill the bag with product. Thus the bag spout is held fixed and the filling nozzle is moved into and out of contact with the spout for filling purposes. The disadvantage of this type of operation is that the delivery conduits for the product to the filling nozzle have to be flexible to allow for movement of the product to the movable filling nozzle. Such flexible lines create a considerable problem where aseptic conditions must be maintained when the containers are being filled with consumer products such as milk, water, fruit juices, and the like. The same problem presents itself where the bags are filled with products that are hot.

Further, in systems such as in U.S. Pat. No. 4,120,134 where the filling nozzle must move, the distance between the empty bag spout and the full bag spout approximately equals the length of the bag which may be as much as 16 inches. Obviously, in addition to the other problems created by movement over such a large distance, time is consumed for the filling operation which, of course, reduces the number of bags which can be loaded in a given period of time.

Also, devices such as that disclosed in U.S. Pat. No. 4,120,134 operate to fill and cap each bag in serial fashion thus performing the task of filling the bag, capping the bag and obtaining a new bag in separate steps. Again, this requires an additional period of time which increases the overall time period for filling the bags and reduces the number of bags which can be filled per a given period of time.

Other patents such as U.S. Pat. No. 3,785,116 are designed for the production of filled and closed plastic containers wherein multiple steps are performed simultaneously. However, they do not relate to the filling of bags which poses an entirely different problem and, in addition, the filling nozzles again are required to move to the spout of the container to be filled thus creating the same problems as discussed previously.

The present invention relates to a device for the automatic filling and capping of containers serially fed to the filling and capping machine. The device not only has a fixed filling nozzle which alleviates the problems discussed earlier, but also has a single shuttle or carriage which has controlled reciprocating movement to enable a capping operation and retrieval of a new bag to occur simultaneously and to place the new bag in a position for filling and simultaneously to obtain a cap for placing on the bag after it has been filled. Further, the bags are fed seriatum to the machine on one side while the caps are fed seriatum to the machine on the other side and the shuttle moves from one side to the other retrieving the bags, placing the bags in a proper location to be filled, retrieving a new cap and capping the bag. A single shuttle or carriage provides a relatively simple device for performing multiple operations thus not only saving time during the filling and capping of the bags but also allows the filling nozzle to remain stationery while the bag is moved to and from the filling nozzle. Further, during the capping operation, the same device that moves the bag to the filling nozzle also moves the bag to the cap chuck which forces the cap into the filling spout thus sealing the bag.

Finally, since the filled and capped bags are ejected in the same location by the present device, only one exit conveyor belt is required whereas in U.S. Pat. No. 3,785,116, a belt is required on each side of the machine.

SUMMARY OF THE INVENTION

Thus, the present invention relates to a method of serially filling and capping containers comprising the steps of providing a filling station with a nozzle for filling said bags, serially providing caps and bags for said filling station from stations spaced from said filling station, positioning an elevator mechanism under said filling station for movement to raise or lower said individual bags to said nozzle to be filled, providing a movable carriage having a cap chuck on one end and a bag chuck on the other end for movement between said bag station and said cap station and synchronizing said filling station, said carriage movement and said elevator mechanism movement whereby said carriage cycles to pick up a new bag while simultaneously positioning for capping a full bag, capping the bag, ejecting the capped, filled bag while moving into place the new bag on said elevator and simultaneously picking up a new cap, returning to a central position, waiting while said elevator raises said new bag to be filled and is then lowered to move said filled bag clear of said carriage, then repeating said cycle. The bag and cap providing stations are spaced at suitable distances from the filling station. In accordance with one embodiment of this invention, the cap and bag providing stations are spaced equidistant from the filling station. Although as just noted, this is not required or necessary.

The invention also relates to a device for automatically filling and capping containers comprising a filler nozzle positioned above an elevator mechanism, a bag station spaced from said filler nozzle and a cap station suitably spaced from said filler nozzle and a movable carriage having a cap chuck on one end and a bag chuck on the other and being mounted for controlled movement between said filler nozzle and said bag station and said filler nozzle and said cap station whereby when said carriage is moved to said bag station, a filled bag is capped at the cap chuck location and a new bag is simultaneously obtained by said bag chuck, when said carriage is moved to said cap station, said capped, filled bag is ejected, said newly obtained bag is received by said elevator mechanism for filling and a new cap is substantially simultaneously obtained from said cap station, and when said carriage is moved to an intermediate position, said elevator mechanism raises said new bag to be filled to said filler spout and lowers said filled bag to said capping position and said cycle repeats itself.

BRIEF DESCRIPTION OF THE DRAWINGS

These and other more detailed and attendant objects and advantages will be disclosed in relation to the attached drawings in which like numerals represent like objects and in which.

DETAILED DESCRIPTION OF THE DRAWINGS

The novel device of the present invention automatically fills and caps containers which are fed to it serially and performs several operations simultaneously in order to save time and provides a stationery filling nozzle to which the bag to be filled is raised for filling purposes.

Figure 1:
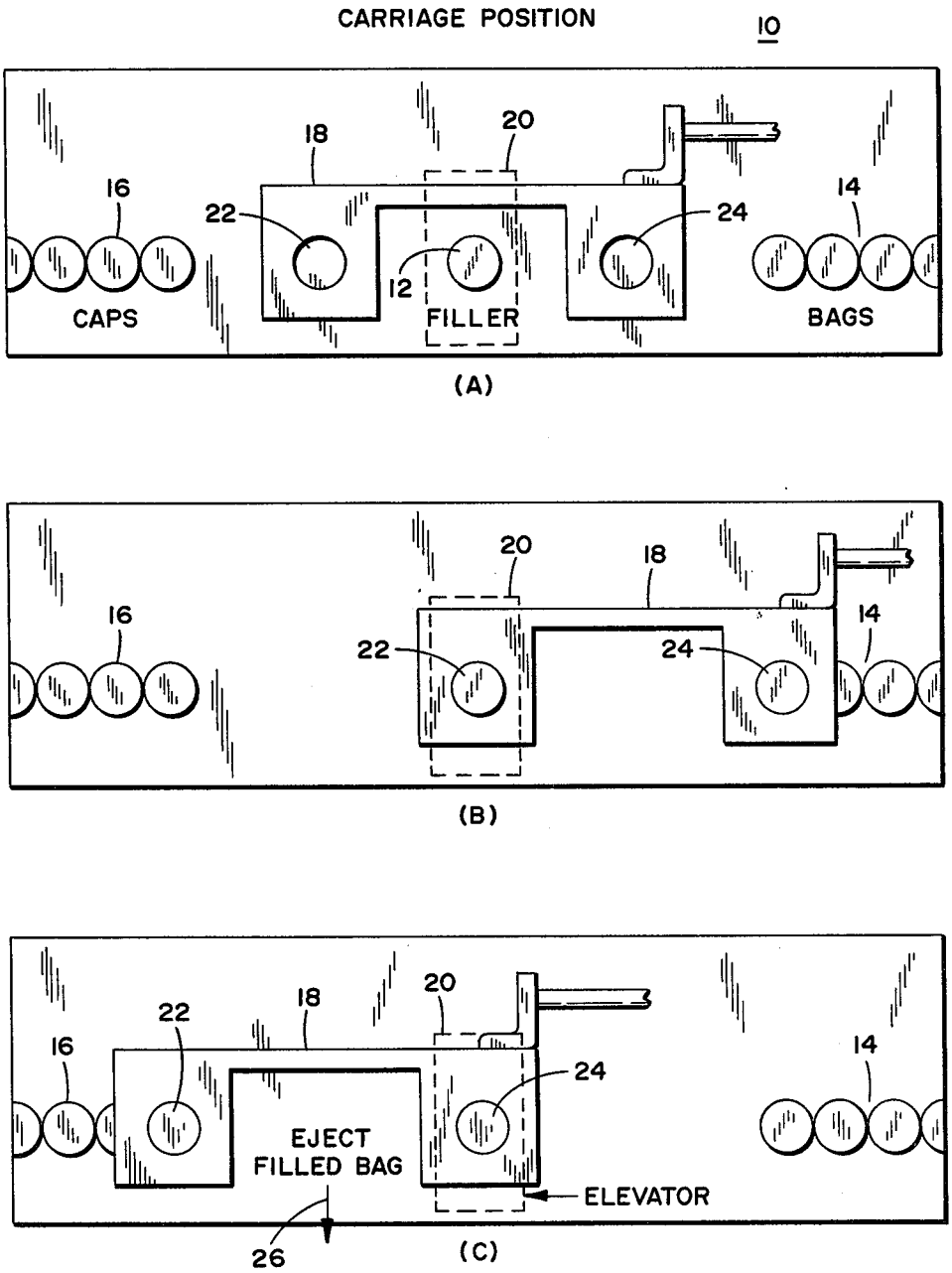
FIGS. 1(A), 1(B) and 1(C) are schematic representations of the carriage position of the novel device as multiple operations are performed in the various positions.

In FIG. 1(A) the novel machine is generally represented by the numeral 10 and includes a stationery filler nozzle 12, a bag station 14, a cap station 16, a shuttle or carriage 18, and an elevator mechanism 20. Carriage 18 has at one end a cap chuck 22 and at the other end a bag chuck 24. Assume in FIG. 1(A) that a bag has been placed on elevator 20 and has been raised to meet filler nozzle 12 for filling the bag with product. Assume also that a cap is loaded in cap chuck 22 and that no bag is in the grip of bag chuck 24. When the bag on elevator 20 is full, the elevator 20 lowers to clear the space for movement of carriage 18. At that time, the carriage 18 moves to the right as shown in FIG. 1(B). While bag chuck 24 is grasping a bag from bag station 14 where bags are fed seriatum to the bag station 14, elevator 20 is moving upwardly under the cap loaded in cap chuck 22 on carriage 18 and the cap is inserted in the filling spout of the filled bag and thus the bag is sealed.

The carriage 18 is then programmed to move to the left as shown in FIG. 1(C) and as it begins its move, it ejects the filled and capped bag as indicated at 26 and continues to move to the position shown in FIG. 1(C). At that time, the bag that had been obtained by bag chuck 24 from bag station 14 when the carriage was to the far right as shown in FIG. 1(B) is received by elevator 20 and simultaneously cap chuck 22 is obtaining a cap on the left side from cap station 16 where the caps are also fed seriatum to the cap station. The carriage then programmed to move to the position indicated FIG. 1(A) at which time elevator 20 raises the new bag placed thereon by bag chuck 24 to the filling nozzle for receiving product. When the bag is filled with product, elevator 20 moves downwardly to clear the carriage 18 to allow it to move and the cycle begins all over again.

Figure 2:
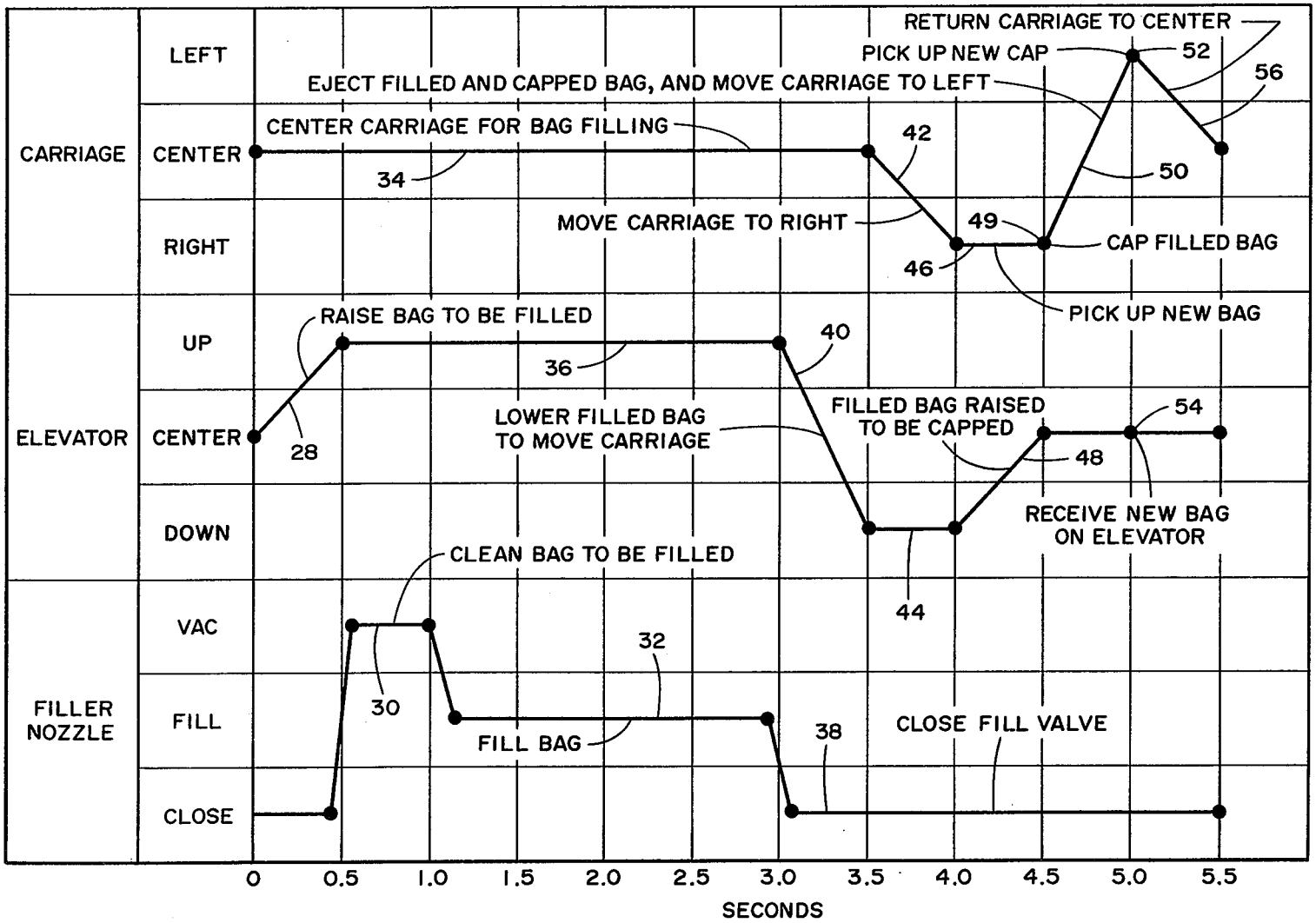
FIG. 2 is a diagram of the operating sequence showing the relationship of the carriage movement to the elevator movement and the filler nozzle operation.

FIG. 2 is a graph illustrating the relationship of the movement of the carriage 18 and the elevator mechanism 20 in relation to the filling of a bag. One complete cycle takes approximately 5½ seconds. The carriage 18 starts out in its center position as shown in FIG. 1A and while it stays in that position, elevator 20 raises the bag to be filled to the filling nozzle as indicated by the graph at 28. When the elevator 20 has reached its up position, the filling spout of the bag is in contact with the filler nozzle 12 and a vacuum is applied to the bag to be filled to clean it of any contaminates as represented by the graph at 30. The bag is then filled as indicated by the graph at 32. During this time, the carriage 18 stays centered as indicated by the graph at 34 and the elevator stays in its up position to hold the bag spout against the filling nozzle as indicated by the graph at 36. The fill valve is then closed as indicated by the graph at 38 and the elevator begins its descent to the down position as shown on the graph at 40 to allow the carriage to move unobstructed. The carriage then moves to the right as indicated by the graph at 42 during which time the elevator stays in the down position as indicated at 44 and the fill valve, of course, stays closed. The carriage stops momentarily when it reaches the right side as indicated at 46 and during that time the elevator raises to the center position as indicated at 48 where it comes in contact with the cap held by the cap chuck 22 shown in FIG. 1(B) and caps the filled bag as indicated at 49 on the graph. The carriage 18 then begins its move to the left as indicated at 50 and during this movement the filled and capped bag is ejected. When the carriage 18 reaches the far left as indicated at 52, the cap chuck 22 picks up a new cap as indicated in FIG. 1(C) and at the same time deposits on elevator 20 the new bag it had received when the carriage 18 was to the far right as indicated in FIG. 1(B) and as indicated in the graph in FIG. 2 at 54. The carriage then returns to the center position shown in FIG. 1(C) as indicated on the graph at 56. Thus the cycle begins again.

Figure 3:
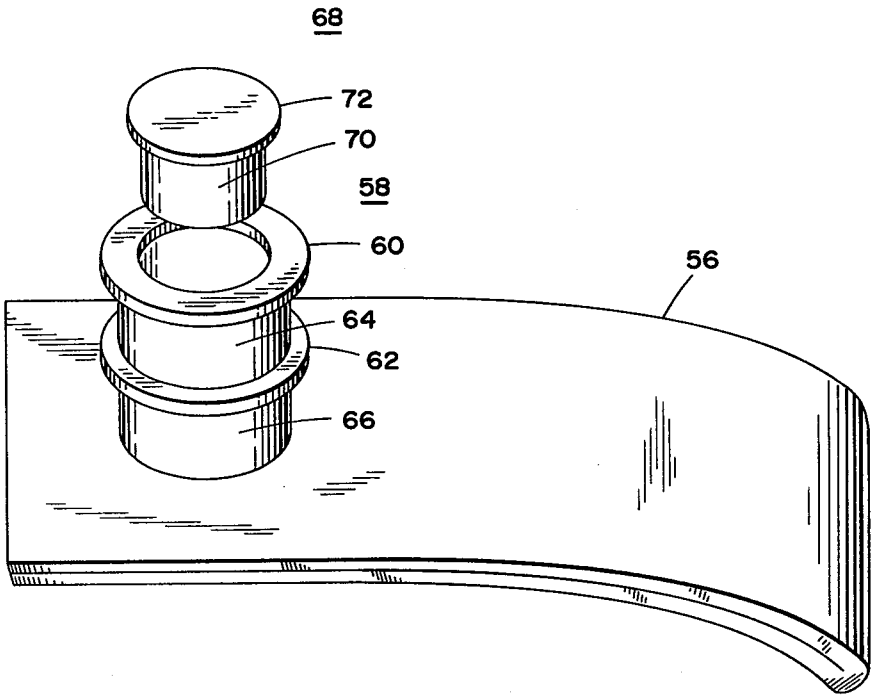
FIG. 3 is an isometric view of one of the bags which is to be filled and capped and illustrating the bag filling spout and the cap which is used to seal the bag after it is filled.

FIG. 3 is an isometric view of one of the bags that can be filled and capped with the present device and illustrates in particular the filling spout and cap for the bag. As can be seen in FIG. 3, bag 56 may be of any flexible material and has at one end a filling spout 58 having first and second flanges 60 and 62 separated by a space 64. Further, a second space 66 exists between the bag and second flange or collar 62. The cap 68 has a generally cylindrical shaped body 70 with a collar or flange 72 on the upper part thereof which rests against flange 60 when the cap 68 is inserted in the filling spout 58 thus sealing the bag. When bag 56 is removed from the serially fed continuous source of bags at bag station 14, the bag chuck 24 of carriage 18 grips filling spout 58 in space 64 between flanges 60 and 62. When it moves the bag to the elevator mechanism, the elevator mechanism has a chuck shown in FIG. 5, which grips the bag 56 in the space 66 under collar or flange 62. In this manner the bag is transferred from the carriage bag chuck 24 to the elevator mechanism 20. Also, the cap chuck 22 grasps the cap 68 about flange 72 in order to position the cap for capping of the bag 56 when the elevator 20 raises the filled bag under cap 68.

Figure 4:
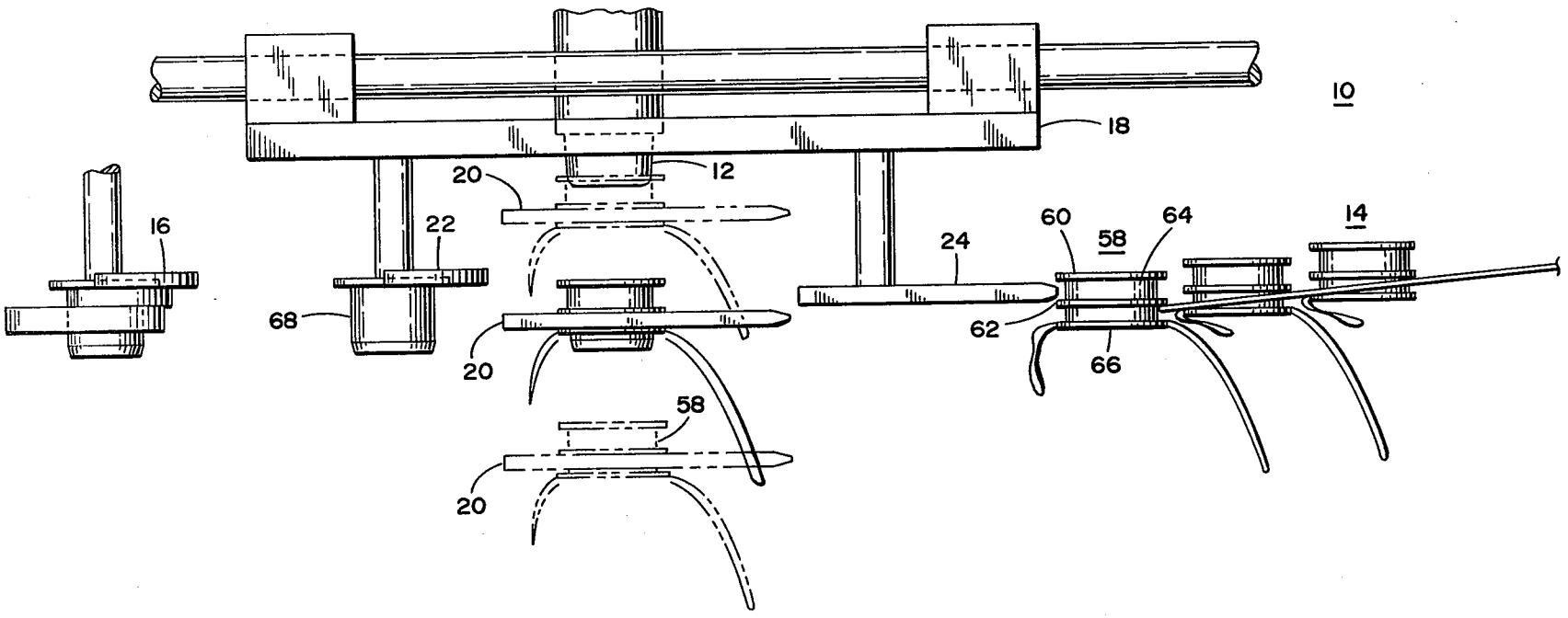
FIG. 4 is a schematic representation of a side view of the novel device illustrating the bag station, the cap station, the elevator mechanism in its three positions and the carriage whose movement can be controlled from the bag station to the cap station and back.

FIG. 4 is a side view of a schematic representation of the novel machine 10 illustrating the relationship of the elevator 20 to the position of carriage 18 and the relationship of carriage 18 to the bag station 14 and cap station 16. As can be seen in FIG. 4, elevator 20 may be positioned in three different vertical locations. The center location enables the elevator chuck to receive the individual bag from the bag chuck 24. The upper position of elevator 20 places the spout of the received bag in contact with nozzle 12 for filling. The lower position clears the bag and the elevator mechanism 20 from the path of movement of carriage 18 so that carriage 18 can move either to the right or left. Further, when cap chuck 22 has moved the cap 68 directly over the bag held by the elevator mechanism in the lower position as shown in FIG. 4, the elevator 20 can then move upwardly causing the cap to be inserted in the bag filling spout 58. As can be seen in FIG. 4, the bag chuck 24 fits between flanges 60 and 62 in space 64 of filler spout 58 thus leaving room for the chuck of elevator 20 to fit in space 66 under collar or shoulder 62 for receiving the bag.

Figure 5:
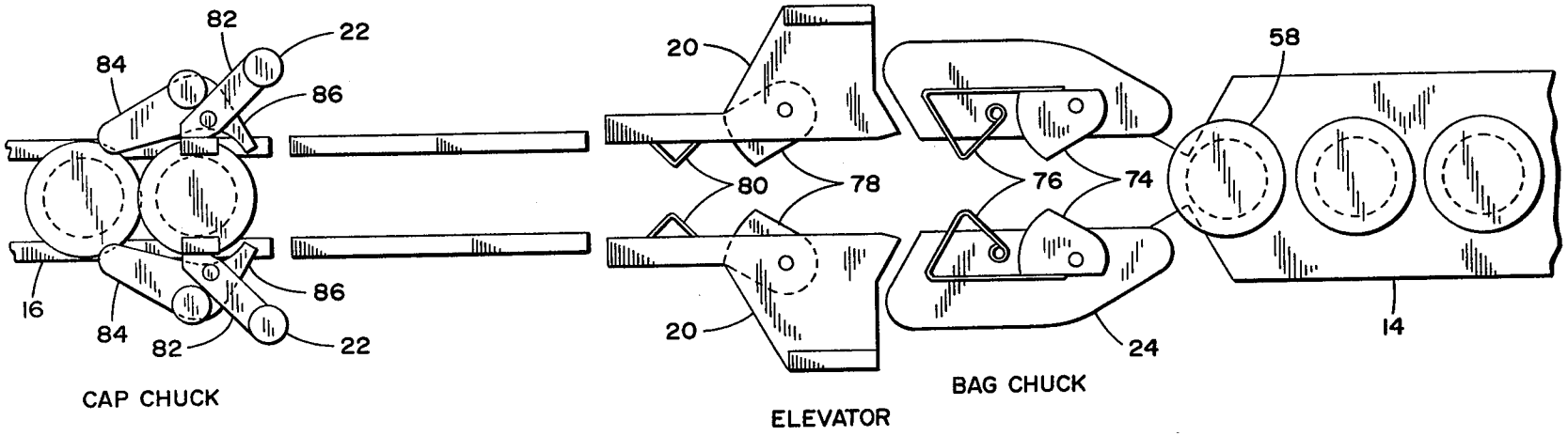
FIG. 5 is a schematic representation of a top view of the novel machine illustrating the bag station, the bag chuck of the carriage, the elevator mechanism, the cap chuck of the carriage and the cap station.

FIG. 5 is a top view of a schematic representation of the novel filling and capping machine. Bag chuck 24 and cap chuck 22 are, of course, both connected to the carriage 18 for simultaneous and duplicate movement. Bag chuck 24, generally speaking, has cams 74 and springs 76 which grip bag pouring or filling spout 58 and retrieve the bag from bag station 14 where the bags are being fed seriatum to the bag station 14. The bags may be fed to bag station 14 in any well known manner as, for instance, by taping the bags together in series and peeling the tape off as the bags enter station 14. The cams 74 open to allow the filling spout 58 to enter bag chuck 24 but then close and, with springs 76, hold the pouring spout 58 tightly within the bag chuck 24 for movement.

Elevator mechanism 20 also has a pair of cams 78 and a pair of springs 80 which function in a similar manner to receive the bag filling spout 58 from bag chuck 24. Again, cams 78 function in a well known manner to allow the neck of filling spout 58 to enter therein and then they close and, in conjunction with springs 80, hold the bag fast for movement to the upper, center, and down positions assumed by the elevator 20. Also, cap chuck 22 receives a cap 68 from cap station 16. Cams 82 function in a well known manner to grasp the cap 68 and hold it until the proper time when the cams are actuated to release the cap. Cams 84 operate in a well known manner in conjunction with cams 82 to hold the caps which are being serially fed into the cap station 16 until they are ready to be received by cam jaws 82. At that time, cams 84 open and allow the cap to move into the area where it can be grasped by cams 82. Cams 84 are designed on the ends 86 thereof so that they prevent the caps from moving outside the grasp of cams 82 until they are firmly picked up by cams 82. All of these caming functions are old and well known in the art and are not disclosed in detail herein because they can be formed in any desired manner to achieve the desired result as indicated.

Thus a new and novel device has been disclosed for serially filling and capping containers such as bags in a manner which does not require movement of the filling nozzle and which utilizes a simple shuttle or carriage mechanism to perform multiple operations simultaneously thereby increasing the speed of operation and efficiency of the device.

While the invention has been described in connection with a preferred embodiment, it is not intended to limit the scope of the invention to the particular form set forth but, on the contrary, it is intended to cover such alternatives, modifications, and equivalents as may be included within the spirit and scope of the invention as defined in the appended claims.

What is claimed is:

1. A method of filling and capping containers, said method comprising the steps of:

(a) providing a filling station having a fixed nozzle for delivering a fluid to the containers;

(b) providing a shuttle which is reciprocally movable along a path between a first container engaging position, a second cap engaging position, and an intermediate position;

(c) providing vertically reciprocating elevator means for engaging containers;

(d) serially providing a supply of containers to said container engaging position, and a supply of caps to said cap engaging position;

(e) moving said shuttle to said container engaging position to engage one container with said shuttle from said supply of containers;

(f) subsequently moving said shuttle to said cap engaging position to engage one cap with said shuttle from said supply of caps while simultaneously engaging said one container with said elevator means;

(g) subsequently moving said shuttle to said intermediate position to release said one container from engagement with said shuttle;

(h) subsequently raising said elevator means toward said fixed nozzle to engage the latter with a filling spout on said one container;

(i) filling said one container with a fluid via said nozzle;

(j) lowering said elevator means away from said fixed nozzle to dispose said one container below the path of movement of said shuttle;

(k) subsequently moving said shuttle to said container engaging position to engage a subsequent container with said shuttle while simultaneously moving said one cap into alignment with the spout on said one container; and (l) subsequently moving said elevator means toward said one cap to engage the latter in the spout of said one container to close the latter.

2. The method of claim 1 comprising the further step of moving said shuttle to said cap engaging position to release said one container from said elevator means and to engage with said shuttle a subsequent cap while simultaneously engaging said subsequent container with said elevator means.

3. The method of claim 1 wherein said shuttle is reciprocally moved along a linear path.

4. Apparatus for filling and capping containers, said apparatus comprising:

(a) a fixed filling nozzle for delivering fluid to the containers;

(b) first means on one side of said filling nozzle for delivering seriatum a supply of containers;

(c) second means on another side of said filling nozzle for delivering seriatum a supply of caps;

(d) shuttle means disposed below said filling nozzle, said shuttle means having a container chuck disposed on one side thereof, and a cap chuck disposed on another side thereof, said shuttle means being reciprocally movable between a container pickup position wherein said container chuck is operable to engage a container and remove the latter from said first means, and a cap pickup position wherein said cap chuck is operable to engage a cap and remove the latter from said second means, and said shuttle means further being movable to an intermediate position between said container pickup position and said cap pickup position; and (e) elevator means disposed below said filling nozzle, said elevator means including a container chuck operable to engage a container carried by said shuttle means container chuck when said shuttle means is in said cap pickup position, and said elevator means being operable to raise an engaged container toward said filling nozzle and into fluid communication with the latter for filling of the container and thence lower the filled container away from said filling nozzle while said shuttle means is in said intermediate position; and said elevator means further being operable to raise the filled container toward said cap chuck when said shuttle means is in said container pickup position to close the filled container with a cap engaged by said cap chuck.

5. The apparatus of claim 4, further comprising means on said cap chuck for disengaging a filled capped container from said elevator means container chuck when said shuttle means is moved to said cap pickup position.

6. The apparatus of claim 4, wherein each of said chucks comprises a pair of cooperating cams and a pair of cooperating springs adjacent to said cams for gripping the article held in said chucks.

* * * * *

UNITED STATES PATENT AND TRADEMARK OFFICE

CERTIFICATE OF CORRECTION

PATENT NO. : 4,481,753

DATED : November 13, 1984

INVENTOR(S) : Christopher C. Rutter et al.

It is certified that error appears in the above-identified patent and that said Letters Patent is hereby corrected as shown below:

On the title page "Assignee:" should read -- Champion International Corp., and Rutter, Pongrass & Associates, Inc., Stamford, CT. (part interest) --.

Signed and Sealed this

*Tenth* Day of *December 1985*

[SEAL]

*Attest:*

DONALD J. QUIGG

*Attesting Officer*

*Commissioner of Patents and Trademarks*